US005854311A

United States Patent [19]

Richart

[11] Patent Number: 5,854,311

[45] Date of Patent: Dec. 29, 1998

[54] PROCESS AND APPARATUS FOR THE PREPARATION OF FINE POWDERS

[76] Inventor: Douglas S. Richart, 6 Golfview La., Reading, Pa. 19606

[21] Appl. No.: 669,143

[22] Filed: Jun. 24, 1996

Related U.S. Application Data

[60] Provisional application No. 60/000,582 Jun. 28, 1995.

[51] Int. Cl.[6] ..... B02C 4/04; B02C 4/00

[52] U.S. Cl. ..... 523/309; 51/298; 239/9; 241/15; 241/16; 241/30; 524/904

[58] Field of Search ..... 51/298; 239/9; 241/15, 16, 30; 523/309; 524/904

[56] References Cited

U.S. PATENT DOCUMENTS

| | | | |
|---|---|---|---|
| 2,347,964 | 4/1944 | Cuno | 523/309 |
| 3,755,244 | 8/1973 | Hart | 523/333 |
| 3,756,979 | 9/1973 | Ventres et al. | 241/16 |
| 3,925,096 | 12/1975 | Karkov | 524/563 |
| 4,176,143 | 11/1979 | Kraft et al. | 524/904 |

FOREIGN PATENT DOCUMENTS

| | | |
|---|---|---|
| 0712125 | 1/1980 | Russian Federation . |

*Primary Examiner*—Peter A. Szekely
*Attorney, Agent, or Firm*—Richard O. Church

[57] ABSTRACT

Methods and means for grinding materials to fine powders in a media mill in which the materials are ground while immersed in a liquid. In the preferred embodiments, the liquid is a gas at room temperatures and pressures, the materials are resin mixtures and the fine powders are predominantly in a size range of from about 10 to about 40 micrometers. Other benefits may be achieved if the gas is in a supercritical state.

17 Claims, 1 Drawing Sheet

PROCESS AND APPARATUS FOR THE PREPARATION OF FINE POWDERS

HISTORY OF THE APPLICATION

This application is based upon and claims priority from my co-pending U.S. Provisional patent application Entitled "Process for Preparing Powders with a Narrow Particle Size Distribution" Ser. No. 60/000,582 filed Jun. 28, 1995.

SUMMARY OF THE INVENTION

This invention relates to methods and means for the preparation of a fine powder and more particularly relates to the comminution of solid particles while immersed in a volatile liquid.

BACKGROUND OF THE INVENTION

A number of processes make use of finely divided dry solid particles in which the particles are neither suspended nor dissolved in a liquid. Powder coating processes are representative of these and include, for example, those used in electrostatic photographic reproduction and in the application of decorative or protecting coatings to a substrate. Sometimes the process simply involves spraying an air suspension of powders against a substrate, but, more commonly, an electrostatic charge is relied upon to deposit the powders. While it is not intended that the invention be so limited, for simplicity of description and ease of understanding, the invention is here described with particular reference to the preparation of fine powders for use in coating processes and, more particularly sill, to electrostatic coating processes. It will be understood, however, that the methods and means of this invention can be used to make powders for any purpose such as, for example, electrostatic toners, pharmaceuticals, catalysts, pigments, dyes and the like.

Since powder coating does not make use of volatile organic compounds (VOC's,) it necessarily follows that no VOC's are evolved during the application or curing of the powder. In electrostatic coating practice, for example, the powder particles are charged in an electrostatic gun and the powders are attracted to and deposited on the surface of the object to be coated (the substrate). The substrate is usually metallic or, if not, its surface must be able to retain an electrostatic charge of opposite polarity to those of the charged powder particles.

The spayed particles are held on the surface of the substrate by electrostatic forces until they are heated to a temperature at which the particles will melt, fuse and flow out into a smooth, continuous film. If the powders are of a heat reactive type, the heating is continued until the are cured. Convection ovens and infrared heaters are convenient equipment in which a substrate may be heated.

While coatings applied from powders have advantages over liquid (i.e. solvent or water) based coatings, powder coatings, unlike liquid based coatings, are difficult to apply in thin (e.g. <1 mil,) uniform films relatively free from orange peel. This is a principal reason why electrostatic coating processes have proven to be of only marginal commercial success in some high volume, cost sensitive applications. These applications demand the thinnest coatings possible which are consistent with providing the desired level of protection or visual appeal. A primer coating for blanks (from which parts may be stamped) or coils are representative examples. Another example is the protective coating that may be applied to the interior surfaces of cans.

In point of fact, to be competitive in these markets, a coating process has to be capable of providing a continuous, corrosion resistant film less than 1 mil in thickness and, preferably, less than 0.5 mils.

Powder coatings have also been limited in commercial use in applications where a very smooth, orange peel free surface is desired, such as for automobile top coats. Powder coatings are often not as smooth and show a higher degree of orange peel than do conventionally applied liquid coatings. As a general rule, coatings prepared from fine powders will be smoother and have less orange peel than will coatings prepared from coarser powders.

Electrostatic powders are commonly formulated by first mixing the individual resins, curing agents, pigments and other ingredients and extruding them under heat and with shear forces to mix and disperse the ingredients uniformly throughout the resinous matrix. This is normally done in an extruder or other melt mixing apparatus. If the resins are of a heat reactive nature (i.e., thermosetting), the mixing time must be minimal to avoid a significant degree of reaction. Process times in the range of from 40 to 60 seconds are typical. Conventionally, after the resins exit from the extruder, the molten mass is squeezed between chilled rolls to form a flat sheet and then further cooled to yield a thin, friable sheet. The sheet is broken into small chips and the chips are ground into a fine powder as in a hammer mill or other comminution devices.

The individual ingredients of a coating powder formulation can also be thoroughly mixed and dispersed by mixing them together with agitation in the presence of a supercritical fluid, such as supercritical carbon dioxide, A process of this sort is described in U.S. Pat. No. 5,399,597, as noted prior art references discussed below. In one aspect of the instant invention, a dispersion of powders in a supercritical fluid is reduced in temperature or pressure to below the supercritical state, and, while still in the liquid state, fed to a media mill as described in Examples I and III. Another suitable media mill is the ADP Discoplex agitator ball mill manufactured by Hosokawa Alpine AG.

Whether formed by dispersion of the ingredients in an extruder, as is common, or in a supercritical fluid, as disclosed in this invention, a mixture of resins, curing agents, pigments, additives and the like will subsequently be referred to herein as a "resin mixture."

The comminution processes known to the prior art conventionally provide coating powders for use in electrostatic spray processes in which the bulk of the particles are in a size range of from about 20 to about 40 micrometers, the largest particles will seldom exceed about 120 micrometers and the superfine particles, that is those less than about 10 micrometers, constitute up to 20% by weight of the ground powders.

Today, most thermosetting powders are ground in an air classifying mill. The larger particles are recycled to or retained within the mill for further grinding until they are reduced to a particle size fine enough to be elutriated from the milling chamber. This type of grinder, and other grinding mills as well, generally produce a substantial amount of superfine particles.

Studies have shown that superfine particles are detrimental to the electrostatic coating process for a number of reasons. Superfine particles tend to cake, they are difficult to fluidize, and they cause problems when transported from a reservoir to the tip of a gun where they are diffused and electrostatically charged. When a high concentration of superfine particles is present, the superfines tend to accumulate on the inside of the hose, especially at bends or where the direction of powder flow is changed. This phenomena is sometimes referred to as impact fusion.

During the electrostatic spraying process, the superfine particles tend to be carried past the object to be coated (over spray). Since they are affected by the aerodynamic movement of the air in the coating booth, the superfines may not be efficiently deposited on the substrate at the same rate as are the larger particles. As the powder spraying continues and the over spray is recycled, the superfines will build up in the coating powders. The expected result is a progressive worsening of the coating process and possible eventual loss of control over the process.

The presence of superfine particles may clog filters used to retain powders within a spray booth. When the filters become clogged, the back pressure on the system will increase which can still further reducing the efficiency of the deposition of the powder on the substrate.

Superfines also can build up at the tip of the gun in the form of "whiskers". The whiskers eventually slough off but they will deposit as an irregular mound of powders on the substrate and not fuse out into a smooth coating.

Efforts have been made to reduce the superfine particles present in coating powders. At the present time, this can only be accomplished by air classification of the powder after it has been ground. As indicated previously, most powders contain as much as 20% by weight of superfine particles which dictates that at least a substantial portion of the superfines be removed and, for purposes of economy, recovered for reprocessing. An air classification step requires extra equipment and processing time which both contribute to an increased cost of producing an acceptable coating powder.

An ideal coating powder for applying thin film coatings, i.e. less than 1 ml, or a very smooth coating with a low degree of orange peel, should be comprised of a narrow cut of particle sizes, usually in a range of from about 10 to 40 micrometers. Even though it is possible to manufacture powder having such a narrow particle size distribution by current methods, i.e., grinding and air classification, it is not cost effective since this particle size range may represent only perhaps about 50 or 60% of the powder produced by a given grinder. Economic need dictates that superfines be reprocessed but this can be quite burdensome because fine powders are difficult to handle, they flow poorly and are generally hard to process.

Much has been written in the open literature about the preparation of fine powders and there are excellent articles discussing such things as comminution devices, preferred powder sizes and size distribution for different purposes, and the use of fine powders in various processes. Reference is her made to the following literature discussing these topics and their content is incorporated into this specification by reference.

"Particle Size Modeling of Powder Paint in a Recovery System" authored by Harry J. Lader and appearing beginning at page 253 of *Powder Coating* '94 *Proceedings.*

"Product Summary: Size Reduction" authored by Kevin Hjerpe beginning at page 64 of *Powder and Bulk Engineering,* June 1994.

"Full-Body Automotive Body Primer Surfaces and Body Piller Black-Out Coating at GM" authored by E. R. Meeserly and K. Lis beginning at page 45 of *Powder Coating,* June 1995.

"Powder Coating: Current Developments, Future Trends" authored by D. S. Richart and presented as a paper at the Waterborne, High Solids, and Powder Coating Symposium on Feb. 22–24, 1995 at the University of Southern Mississippi.

"Particle Size and Powder Performance" authored by W. B. Anthony beginning at page 253 of the *Powder Coating* '92 *Conference Proceedings.*

"Dispersing With a Laboratory Bead Mill" authored by C. Getzmann beginning at page S6 of *European Ink Maker,* Aug. 10/24 1994.

"Powder Particle Size Matters" authored by D. S. Tyler appearing in *Products Finishing"* in January 1990.

"Analytical Approach for High Quality Appearance Powder Coatings" written by J. C. Kenny, et al. in *Journal of Coating Technology* Vol. 68, page 855, April 1996.

"Powder Technology" authored by D. S. Richart beginning at page 635, volume 6 of *Kirk-Othmer Encyclopedia of Chemical Technology,* 4th Edition.

U.S. Pat. No. 4,689,241 to D. S. Richart.

U.S. Pat. No. 5,319,001 to Morgan et al.

DISCUSSION OF PRIOR ART

U.S. Pat. No. 5,399,597 teaches the preparation of coating powders by mixing all the ingredients in a heated supercritical fluid and forming particles by spraying the supercritical mixture into a vessel below the super critical pressure. The particles are formed by fluid atomization or "flashing" the supercritical fluid into a gas. Few details are given of the particle size distribution obtained using this process.

A method for preparing polymeric powders with a narrow particle size distribution is described in EU 0661 091 A1. In this instance, however, the particles are formed above the melting point of the polymer by agitation in a liquid, preferably a supercritical fluid.

U.S. Pat. No. 5,319,001 teaches that very fine particles e.g. <10 micrometers can be prepared in a media mill using water as a process fluid. The patent teaches that the particles must be recovered by spray drying and then agglomerated to form larger particles that are suitable for application by electrostatic spray techniques.

There is no indication in any of the prior art that polymeric powders, in a size range of about 10 to 40 micrometers and having a narrow particle size distribution can be prepared by grinding in a media mill using a liquefied gas as the process media.

SUMMARY OF THE INVENTION

Accordingly, it is an object of the invention to provide improved methods and means for the production of fine powders.

Another object of this invention is to provide methods and means for the production of fine powders in which the bulk of the powders is in a desired range, typically from about 10 to 40 micrometers.

Another object of this invention is to provide a process for the comminution of powders which minimizes the production of superfines.

Another object of this invention is to provide methods and means for preparing fine powders predominately in the 10 to 40 micrometers range having a low concentration of particles less than 10 micrometers.

Another object of this invention is to provide methods and means for the production of a fine powder that is especially adapted for use in coating substrates with decorative and protective coatings having a thickness of 1 mil or less.

Another object of this invention is to provide coating powders that can be applied to form a coating that is relatively free from orange peel.

Another object of this invention is to prepare coating powders that will be especially useful in applying films of less than 1 mil in electrostatic powder coating processes.

Another object of this invention is to prepare coating powders which can be sprayed continuously over a period of days or weeks on automatic electrostatic spray coating lines with a continuous powder recycle system without excessive build up of superfine powder from occurring.

Another object of this invention is to prepare toners as for use in printing and electrostatic printing processes in which the powders are comprised of particles which are essentially all below 10 micrometers and relatively few of which are less than 3 micrometers.

These and other objects of this invention are achieved by grinding powders in a media mill in the presence of a liquid vehicle. It has been discovered that grinding in media mills, while the powders are dispersed in a liquid vehicle, makes it possible to control the particle size distribution with greater accuracy, to reduce the production of undesirable superfines and to improve the overall efficiency of the grinding operation. It is believed that greater efficiencies are achieved by the transmission of the energy through the liquid to the powders which also permits control of the maximum particle size by the choice of operating conditions.

While it is possible that various types of wet grinding devices can be used, the so called bead or media mills appear to be preferable. These consist of a chamber filled with spherical or mostly spherical media, usually glass or ceramic, and an agitator which causes the media to move relative to each other. The material to be ground or dispersed is introduced as a slurry and caused to flow through the agitated media to a discharge chamber. The slurry is forced through the agitated media under pressure, usually by pumping. Grinding can also be carried out in a similar fashion in a noncontinuous process. In this case, the material to be ground is introduced into a closed vessel with the media. The media are agitated as in a continuous mill and the powder is discharged when the desired particle size has been reached.

Particle size can be determined by controlling a number of variables such as the size of the media, the rate of flow of the slurry through the mill, and the energy imparted to the media by the speed of the agitator, among others. Further, generation of superfine particles, i.e. those <10 micrometers is minimized by the choice of a larger media so that the interstitial distance between the beads, or media, is larger than 10 micrometers, or so. This allows finely ground particles to pass through the mill without further reduction in particle size.

Wet grinding methods such as described have seldom been used to prepare dry powders for electrostatic spray coating since it is extremely difficult to separate the powder from the liquid vehicle. The liquid vehicle should be inert with respect to the powder so the powder particles do not dissolve. Water or high boiling hydrocarbon liquids would probably be suitable. While these vehicles may be practical on a small scale basis using a thin film evaporator or other agitated vacuum apparatus or a spray dryer to remove the liquid from the powder, such processes are uneconomical and seldom practical on a large scale basis. The equipment is difficult to clean and the batch size of the powder produced is frequently small, e.g. 500–1000 lb.

In the preferred practice of this invention a volatile liquid is used as the vehicle and, more preferably still, a liquid is used which will volatilize at ambient temperatures. Liquefied gases, such as nitrogen, carbon dioxide or refrigerants are illustrative examples. Since these liquids are gasses at room temperature, they can be readily removed without relying on a heat or vacuum process. Carbon dioxide is a preferred vehicle since it is a gas at room temperature, it is non-toxic, is leaves no residue on the powder particles, it is relatively inexpensive and it can be liquefied at only moderately low temperatures.

When liquid carbon dioxide (or any other liquid which volatilizes at room temperatures) is selected as the liquid vehicle, the equipment is designed to operate at super atmospheric pressure and maintain the vehicle in a liquid state during the grinding process. As a generality, it is easier to contain the liquid vehicle under pressure in a batch operated mill than it is in a continuously operated mill. However, as the partial pressure of carbon dioxide at room temperatures is only about 72 atmospheres (1050 psi), the liquefied carbon dioxide is relatively easy to contain and equipment design problems are minimized. The equipment may also operate at atmospheric pressure but more carbon dioxide will be consumed as a result of the loss by vaporization.

In a modification of this process, the temperature and pressure can be adjusted to above the supercritical conditions of the volatile liquid. In the case of carbon dioxide, the supercritical temperature is 31.1° C. at a pressure of 1071 psig. By operating in the supercritical phase, carbon dioxide will have a solvating effect on the powder particles, especially so of the finer particles because of their higher surface to mass ratio. As such, the finer particles may agglomerate with each other, or with larger particles, further reducing the concentration of the fine particles.

Since the resin particles are partially solvated while in contact with supercritical carbon dioxide, it is an ideal time to adhere additives onto the surfaces of the powder particles. Such additives might include, for example, metallic or nonmetallic flakes, catalysts or accelerators, additives to modify charging characteristics, colorant particles, powder free flow additives and other like materials as will occur to those skilled in the art.

In addition to coating powders used in the electrostatic spray process, this invention will find utility in other areas in which finely divided powders are utilized. These include, for example, electrostatic toners, pharmaceuticals, catalysts, pigments, dyes and the like which may require particles of a size less than 10 to 15 micrometers. The process of the invention here disclosed is simpler and more economical than are those currently used air impact, jet mills or conventional fine grinding machines.

DETAILED DESCRIPTION OF THE DRAWING

Figure 1:
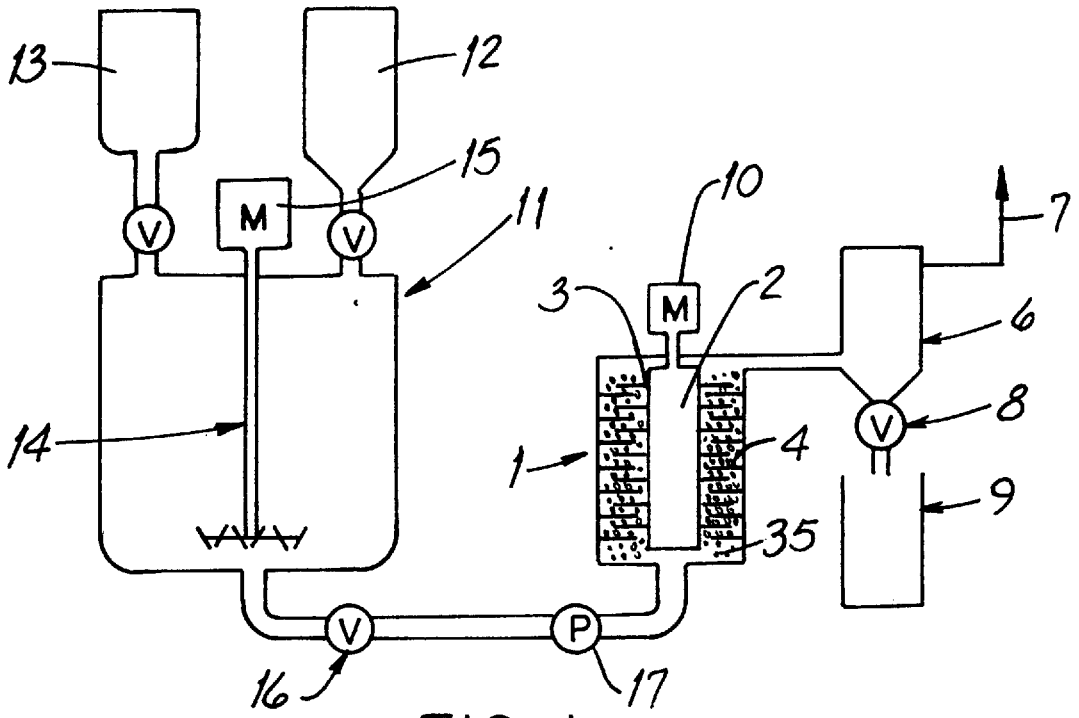
FIG. 1 is a schematic representation of apparatus suitable for use in the practice of this invention.
Figure 2:
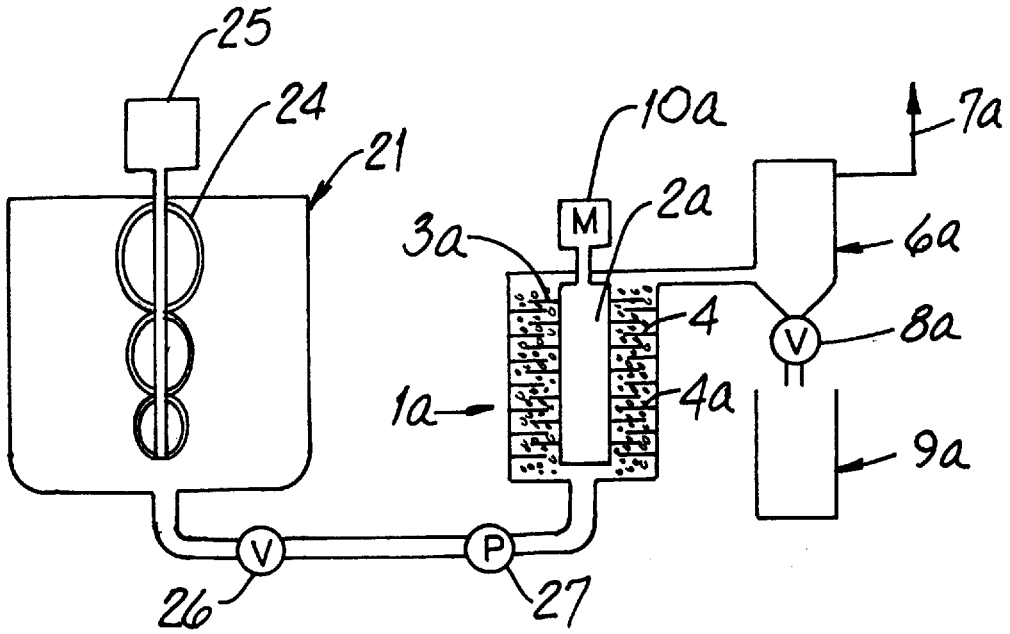
FIG. 2 is a schematic representation of another set of apparatus, generally similar to that illustrated in FIG. 1, also suitable for use in the practice of the invention.

In FIGS. 1 and 2, similar elements are numbered the same except that the similar elements in FIG. 2 are followed by an "a."

FIG. 1 illustrates an operation in which a resin mixture contained in a feed hopper 12 and a liquefied gas contained in a pressure chamber 13 are introduced into a mixing vessel 11. Prior to its introduction into the mixing vessel 11, the resin mixture is processed by melt blending the several components of the resin mixture together using methods well known in the prior art and referred to in the preceding discussion of the background art. The mixing vessel 11 has a rotatable agitator 14 which is driven by an electric motor 15. After the mixing vessel 11 is charged with the resin mixture from the feed hopper 12 and the liquefied gas from pressure chamber 13, the mixing vessel 11 is sealed and the agitator 14 is rotated by the motor 15. Under the action of the agitator 14, the resin mixture is dispersed in the liquefied gas. The resulting dispersion is discharged from the mixing vessel 11 through a valve 16. The dispersion of the resin mixture and the liquefied gas is maintained under sufficient pressure to prevent substantial volatilization of the liquefied gas and conveyed by means of a pump 17 into the entrance end of a media mill 1.

The media mill 1 is comprised of a motor 10 which, when energized, causes a rotor 2 and its attached blades 3 to turn rapidly. Fixed blades 4 are mounted on the inside wall of the media mill 1 in staggered, interleaving relationship with the rotating blades 3 which are attached to the rotor 2. When the rotor 2 turns, the attached blades 3, in cooperation with the fixed blades 4, produce a violent churning of the media 15 which perform work on the dispersion. This working is utilized to grind the resin mixture into a powder. It is believed that by conducting the grinding operation while the resin mixture is dispersed in the liquefied gas, the efficiency of the process is improved by the transmission of forces generated within the media mill to the resin mixture by means of the liquefied gases surrounding the solid particles of the resin mixture.

The ground or comminuted powder is discharged from the media mill 1 and into a separating vessel 6. Separating vessel 6 is maintained at essentially atmospheric pressure by relieving the partial pressure of the liquefied gas through a vent 7. Since the liquefied gas is not contained under a significant pressure in the separating vessel, the liquefied gas flashes into its gaseous phase and the ground powder is permitted to settle within the separating vessel 6. The particles of ground powder can settle by gravity or, more efficiently, the separating vessel may be or may contain one or more cyclone separators (not shown.) The ground powders which have been separated from the expanded gases are discharged form the separating vessel 6 by means of a valve 8 and directed to a receiving station 9 where, for example, they may be packaged for shipment.

The apparatus illustrated in FIG. 2 utilizes the same apparatus for grinding and powder/gas separation as is illustrated in FIG. 1. For this reason, the same numerals 1 through 10 are used to identify the same apparatus except the numerals are followed by an "a" in FIG. 2. The difference between the two sets of apparatus lies in the manner in which the resin mixture is processed prior to its introduction into the media mill 1.

As illustrated FIG. 2 a sealed vessel 21 is fitted with an agitator 24 driven by a motor 25. The vessel 21 is utilized by adding the resin and all of the additives, such as curing agents, pigments, inorganic solids and other additives directly to the vessel 21 without first forming a resin mixture. The liquefied gas is also added to the mixing vessel 21 but, in this instance, conditions, that is of temperature and pressure, are established within the mixing vessel 21 so that the liquefied gas is maintained in a supercritical state. As has been recognized in the prior art, most notably in U.S. Pat. No. 5,399,597 discussed with the prior art above, gases, and particularly carbon dioxide, will solvate some uncured resins and thermoplastic polymers when in the supercritical state. Accordingly, the resin is dissolved in the supercritical fluid to facilitate an intimate mixture of the dissolved resin and the various compounding additives. In effect, the variation shown in FIG. 2 eliminates the need to make a resin mixture in a step prior to introduction into the mixing vessel 21. While in solution, the resin cannot be ground in a media mill 1 and so, by appropriate adjustment of the temperature and pressure, utilizing in part the pumping pressure in the pump 27, the material introduced into the media mill is a mixture of a liquefied gas, no longer at it supercritical point, and a resin mixture in particulate form.

In the Examples that follow all percentages are given by weight unless otherwise noted.

EXAMPLES

Example 1

A thermosetting coating powder based on a mixture of epoxy and acid functional polyester resins was prepared by extrusion in a known manner. See, for example, Kirk-Othmer Encyclopedia of Chemical Technology, 4th Ed., Vol. 6 pp 635–661. The extrudate was formed into a continuous sheet by passing it through chilled nip rolls and solidified on a stainless steel cooling belt. It was broken into flat chips approximately 4 to 8 mm in size using a coarse crusher at the end of the cooling belt.

16.5 lb. of chips were placed in a mixing vessel; 16.5 lb. of water was added and the chips were mixed for one hour on a high speed mixer running at 2500 rpm to form a slurry of powder particles in water. The mixer used is sold under the trade name PMD 50 VC by Netzsch, Inc. Exton, Pa. This type of mixer is widely used in the paint industry and is also referred to as a colloid mill. The slurry of powder particles had a wide particle size distribution with particles ranging from less than 10 micrometers to 460 micrometers with a median particle size of about 80 micrometers. The slurry was mixed with additional water to give a powder concentration of 16%. 0.2% of a wetting agent (Triton X-100) was added and pumped through an agitated media mill at a rate of 6 liters/minute. The mill had a capacity of 4 l, was filled to 70% of it's volume with 3 mm glass beads and was agitated at 1060 rpm. This mill is sold by Netzsch, Inc. under the trade name LMZ-4 Zetamill. After passing through the mill, the powder in the slurry was significantly reduced in particle size to a median size of 22.47 micrometers. This product was passed through the mill a second and then a third time under the same conditions. The agitation of the mill was increased to 1760 rpm and a portion of the $3^{rd}$ pass the material passed through the mill again. The changes in particle size of the product prepared under these various operating conditions are summarized in Table 1.

These results show that in subsequent passes through the mill, the fraction of very fine particles, i.e. those less than 10 micrometers, increased only slightly while the larger particles were dramatically reduced in particle size. That is, a fine powder with a narrower distribution of particle sizes was obtained.

TABLE 1

Particle Size Distribution of Powders Produced at Various Conditions

| Particle Size | 1st Pass 1060 rpm | 2nd pass 1060 rpm | 3rd pass 1060 rpm | 3rd pass 1760 rpm |
|---|---|---|---|---|
| <10μ - % | 22 | 20 | 20 | 24 |
| Median particle size μ | 23 | 22 | 21 | 19 |
| Top particle size - μ | 90 | 70 | 80 | 52 |

Example 2

Chips from the extruder as in Example 1, were dispersed in an equal amount of water using a high speed dissolver, sold by Netzsch under the trade name HSD. The chips were mixed for 1 hour to form a coarse dispersion suitable for introduction to a media mill. The media mill used in this example is a 101 vertical mill, similar to that of Example 1, sold by Netzsch under the trade name LMZ 10 Zeta Mill. The mill was charged to 70% of its capacity with 3.5–4.5 mm ceramic beads, and agitated at 800 rpm. Slurry was introduced at the rate of 12 l/min. The product produced had a median particle size of 21 micrometers, a top particle size of 40 micrometers, and a 10 micrometers fraction of 24%.

Example 3

Chips from an extruder as in Example 1 were ground on a 40 liter vertical mill using 4 mm steel spheres as the grinding media. The mill is manufactured by Draiswerk, Inc. under the designation PMV 40 STX DDA. In this mill, the solids are introduced into the grinding chamber by an auger and the grinding fluid introduced at the same point but as a separate stream. Chips were fed to the mill using a volumetric feeder and water was pumped into the mill from a reservoir so the ratio of chips to the total of chips and water fed to the mill was 35%. The running conditions were varied as follows and samples were collected under each set of conditions:

| | Sample 1 | Sample 2 | Sample 3 | Sample 4 |
|---|---|---|---|---|
| Feed Rate - lb/hour | 200 | 300 | 200 | 300 |
| Rotor Speed - RPM | 530 | 530 | 600 | 600 |

The particle size analysis of each sample was run on a Leeds and Northrop Microtrac Particle Size Analyzer with the results shown in Table 2.

TABLE 2

Particle Size Distribution of Powders Produced under Various Conditions

| Percentile Points (1) | Sample 1 | Sample 2 | Sample 3 | Sample 4 |
|---|---|---|---|---|
| 10% (approx.) | 7 | 5.2 | 4.5 | 5.2 |
| 50% | 18.8 | 14.1 | 13.6 | 16.2 |
| 90% (approx.) | 44.5 | 39.0 | 47.3 | 45.0 |
| Mean Volume (2) | 22.9 | 19.6 | 20.8 | 21.5 |

(1) Percentile Points (micrometers) show the given percent of the volume (or weight, if the specific gravity for all the particles is the same; generally a good assumption) that is smaller than the indicated size. The %50 is also known as the median diameter which is one measure of "average particle size".
(2) Mean Diameter (micrometers) of the volume distribution provided by Microtrac. This is a weighted value of "average particle size", or the center of gravity of the distribution.

By way of comparison, the particle size distribution of a powder coating product of similar composition (also run on the Microtrac Analyzer) ground on a widely used air impact mill with internal particle classification had the characteristics shown in Table 3. This powder was ground on the coarse side, so as to reduce the generation of very fine particles. However, this powder is too coarse for many applications where a thinner film or smoother coating is desired. In order to improve these characteristics, the powder must be ground to a finer average particle size. When the powder is ground finer, however, the amount of very fine particles increases proportionately, leading to the problems previously described. Therefore, when grinding to a finer particle size, it is common practice to insert an air classifier in the grinding train to remove a fraction of the very fine particles. Typically, some 10–15% of the total powder is removed as superfines.

The particle size distribution of a finer particle size air classified powder is compared in Table 3 with the unclassified powder. It can be seen that air classified powder is finer and has a more narrow particle size distribution than the unclassified powder. It is similar in particle size distribution, although somewhat coarser, to those powders produced on the bead mill. (Table 2) That is, the bead mill produced powder possessed a finer particle size and a similar narrow particle size distribution without particle classification while the conventionally produced powder required air classification to achieve a similar result.

TABLE 3

Particle Size Analysis of Powders Ground on an Air Impact Mill

| Percentile Points | Coarse Ground Powder Unclassified | Finer Ground Powder with Air Classification |
|---|---|---|
| 10% | 11 | 9 |
| 50% | 37 | 25 |
| 90% | 85 | 46 |
| Mean Volume | 43 | 25 |

While the above Examples show the use of water as the fluid grinding medium or process liquid, it is to be understood that similar results can be expected when the grinding medium is a liquefied gas.

I claim:

1. A method for grinding in a media mill in which a coarse material is comminuted to a smaller particle size, the improvement comprising grinding coarse material in excess of 120 micrometers while it is immersed in a liquified gas, which is a gas at room temperature and under atmospheric pressure.

2. A method according to claim 1 wherein the liquid is selected from the group consisting of nitrogen, carbon dioxide, sulfur dioxide and a refrigerant.

3. A method for controlling the particle size distribution of materials ground in a media mill which comprises grinding the materials in the presence of a liquefied gas, which liquefied gas is a gas at room temperatures and at atmospheric pressures.

4. A method according to claim 3 wherein the materials are a resin mixture.

5. A method according to claim 4 wherein the resin mixture is ground to provide a coating powder in which the bulk of the particles are in a size range of from about 10 to 40 micrometers.

6. A method according to claim 3 wherein the resin mixture is ground to provide a powder useful as a toner in electrostatic printing processes in which the particles are essentially in a size range of from about 3 to 10 micrometers.

7. A method according to claim 3 wherein the liquid vehicle is carbon dioxide.

8. A method according to claim 3 wherein the liquefied gas is in the supercritical state.

9. A method for producing a powdered resin from a resin mixture in which the powdered resin has a particle size distribution such that the largest particles are less than 100 micrometers, the smaller particles are less than 12 micrometers, and the smaller particles are present in an amount less than 20 wt %, comprising the steps of:

a. immersing the resin mixture in a liquefied gas which is a gas at room temperatures and atmospheric pressure to form a slurry, and b. grinding the slurry in a media mill.

10. A process according to claim 9 wherein the slurry is discharged from the mill and the powders are separated from the liquid media.

11. A process according to claim 9 wherein the resin mixture is a thermosetting resin system suitable for use in powder coating applications.

12. A powder coating material suitable for application by electrostatic spraying made by the method of claim 9.

13. A toner material made by the method of claim 9.

14. A method for controlling the particle size distribution of particles ground in accordance with claim 9 wherein the particles are adapted for use from the group consisting of electrostatic toners, pharmaceuticals, catalysts, pigments, and dyes.

15. A method for producing powdered resin from a resin mixture comprising the steps of:

mixing the resin mixture with a liquefied gas that is in the supercritical state, solvating substantially all of the resin in the resin mixture, adjusting the temperature and pressure to yield a liquefied gas that is no longer in the supercritical state to precipitate the resin and form a slurry, grinding the slurry in a media mill, and vaporizing the liquefied gas from the slurry to form a dried powdered resin.

16. A method according to claim 15 wherein the size range of particles in the dried powdered resin is substantially in the size range of from about 10 to 40 micrometers.

17. A method according to claim 16 wherein substantially all of the particles have diameters of less than about 10 micrometers.

* * * * *